US010710214B2

(12) United States Patent
Tchakarov

(10) Patent No.: US 10,710,214 B2
(45) Date of Patent: Jul. 14, 2020

(54) POLISHING OR GRINDING PAD WITH MULTILAYER REINFORCEMENT

(71) Applicant: HUSQVARNA AB, Huskvarna (SE)

(72) Inventor: Tchavdar V. Tchakarov, Monroe, MI (US)

(73) Assignee: Husqvarna AB, Huskvarna (SE)

( * ) Notice: Subject to any disclaimer, the term of this patent is extended or adjusted under 35 U.S.C. 154(b) by 182 days.

(21) Appl. No.: 15/867,908

(22) Filed: Jan. 11, 2018

(65) Prior Publication Data

US 2019/0210192 A1 Jul. 11, 2019

(51) Int. Cl.

| | |
|---|---|
| ***B24B 7/18*** | (2006.01) |
| ***B24B 7/22*** | (2006.01) |
| ***B24D 11/00*** | (2006.01) |
| ***B24D 13/14*** | (2006.01) |
| ***B24D 7/14*** | (2006.01) |
| ***B24D 18/00*** | (2006.01) |
| ***B24D 7/06*** | (2006.01) |

(52) U.S. Cl.

CPC ..... *B24D 7/14* (2013.01); *B24B 7/18* (2013.01); *B24B 7/186* (2013.01); *B24B 7/22* (2013.01); *B24D 7/06* (2013.01); *B24D 11/00* (2013.01); *B24D 13/14* (2013.01); *B24D 13/142* (2013.01); *B24D 18/00* (2013.01)

(58) Field of Classification Search

CPC .. B24B 7/18; B24B 7/186; B24B 7/22; B24B 41/047; B24D 11/00; B24D 13/14

USPC ..... 451/353

See application file for complete search history.

(56) References Cited

U.S. PATENT DOCUMENTS

| | | | | |
|---|---|---|---|---|
| 2,174,902 A | | 10/1939 | Stratford | |
| 2,225,193 A | | 12/1940 | Benner et al. | |
| 2,425,368 A | * | 8/1947 | Doermann | B24D 7/16 451/548 |
| 2,556,983 A | | 6/1951 | Root | |
| 2,662,454 A | | 12/1953 | Whiteman | |
| 2,819,568 A | | 1/1958 | Kasick | |
| 2,963,059 A | | 12/1960 | Grub | |

(Continued)

FOREIGN PATENT DOCUMENTS

| | | |
|---|---|---|
| CA | 159666 | 7/2015 |
| CA | 162792 | 7/2015 |

(Continued)

OTHER PUBLICATIONS

Diamond Tool Supply, Inc., "Tools for Concrete" Catalog, (published on or before May 2013).

(Continued)

*Primary Examiner* — Eileen P Morgan
(74) *Attorney, Agent, or Firm* — Burr & Forman LLP

(57) ABSTRACT

A polishing or grinding pad with a multilayer reinforcement is provided. In one aspect, a floor polishing or grinding pad assembly employs a flexible pad, at least two reinforcement layers or rings with different characteristics, and multiple floor-contacting tools such as abrasive disks. In another aspect, a workpiece polishing or grinding pad assembly includes a flexible and rotatable pad, a polymeric reinforcement layer coupled to the pad and a metallic reinforcement layer to which are coupled abrasive tools. In yet another aspect, a floor-facing reinforcement is more flexible than a pad-facing reinforcement which is more rigid.

12 Claims, 11 Drawing Sheets

(56) References Cited

U.S. PATENT DOCUMENTS 3,121,982 A * 2/1964 Miller ..... B24D 7/06 451/548
3,452,381 A 7/1969 Bratti
3,464,166 A * 9/1969 Bouvier ..... B24D 13/14 451/548
3,487,589 A 1/1970 Binkley
3,517,466 A * 6/1970 Bouvier ..... B24D 13/14 451/490
3,591,884 A 7/1971 Grueb
3,686,703 A 8/1972 Ray
3,823,516 A 7/1974 Christian
3,934,377 A 1/1976 Tertinek
4,058,936 A 11/1977 Marton
4,271,557 A 6/1981 Caron
4,502,174 A 3/1985 Rones
4,554,765 A 11/1985 Grimes et al.
D284,969 S 8/1986 Olovsson
4,694,615 A 9/1987 MacKay, Jr.
4,724,567 A 2/1988 Rones
4,781,556 A 11/1988 Paul
4,874,478 A 10/1989 Ishak et al.
4,939,872 A 7/1990 Revelin et al.
5,020,280 A 6/1991 O'Reilly
5,054,245 A 10/1991 Coty
5,076,023 A * 12/1991 Saguchi ..... B24D 7/066 451/540
5,170,595 A 12/1992 Wiand
5,174,795 A 12/1992 Wiand
5,247,765 A * 9/1993 Quintana ..... B24D 7/063 451/548
5,372,452 A 12/1994 Hodgson
5,449,406 A 9/1995 Presti, Jr.
5,452,853 A 9/1995 Shook et al.
5,477,580 A 12/1995 Buysse
D367,743 S 3/1996 Krause et al.
5,567,503 A * 10/1996 Sexton ..... B24B 7/22 428/137
5,586,930 A * 12/1996 Hayashi ..... B24B 7/22 451/548
5,605,493 A 2/1997 Donatelli et al.
5,607,345 A 3/1997 Barry et al.
5,632,570 A 5/1997 Balling
5,632,790 A 5/1997 Wiand
5,683,143 A 11/1997 Peterson et al.
5,782,682 A * 7/1998 Han ..... B24B 7/22 451/548
5,807,022 A 9/1998 McCleary
5,882,249 A 3/1999 Ferland
5,970,559 A 10/1999 Christy
6,059,644 A 5/2000 Manor et al.
6,196,911 B1 * 3/2001 Preston ..... B24D 18/00 451/548
6,206,771 B1 3/2001 Lehman
6,234,886 B1 * 5/2001 Rivard ..... A47L 11/164 451/353
6,261,164 B1 * 7/2001 Rivard ..... A47L 11/164 451/353
6,298,518 B1 10/2001 Umbrell
6,299,522 B1 10/2001 Lee
6,371,842 B1 4/2002 Romero
6,382,922 B1 5/2002 Lewis et al.
6,536,989 B2 3/2003 Rijkers
6,625,951 B1 9/2003 McCarthy
6,641,627 B2 11/2003 Keipert et al.
6,739,963 B1 5/2004 Mas Garcia
6,830,506 B2 12/2004 Catalfamo
D503,602 S 4/2005 Hede
D506,376 S 6/2005 Hede
D509,121 S 9/2005 Hede
D510,850 S 10/2005 Boler, Jr.
6,971,821 B1 12/2005 Mansour et al.
7,004,676 B2 2/2006 Williams
7,033,258 B2 4/2006 Jordan
7,059,801 B2 6/2006 Snyder et al.
7,094,138 B2 8/2006 Chang
7,104,739 B2 * 9/2006 Lagler ..... B27C 1/005 299/41.1
7,144,194 B2 12/2006 Kipp, Jr.
7,147,548 B1 * 12/2006 Mehrabi ..... B24B 7/186 451/323
7,172,365 B2 2/2007 Lutz et al.
7,192,339 B1 * 3/2007 Harding ..... B24B 7/186 451/350
7,204,745 B2 4/2007 Thysell
7,223,161 B2 5/2007 Kodani et al.
7,261,623 B1 8/2007 Palushi
D559,063 S 1/2008 Okamoto et al.
7,326,106 B1 2/2008 Rogers et al.
D576,855 S 9/2008 Okamoto et al.
D580,728 S 11/2008 Umbrell
D581,237 S 11/2008 Okamoto et al.
D584,591 S 1/2009 Tano et al.
7,481,602 B2 * 1/2009 Lampley ..... E04F 21/245 404/112
7,506,644 B2 3/2009 Park
7,520,800 B2 4/2009 Duescher
D592,029 S 5/2009 Tano et al.
D592,030 S 5/2009 Tano et al.
D600,989 S 9/2009 Tano et al.
D612,874 S * 3/2010 Nilsson ..... D15/138
7,670,208 B2 * 3/2010 Thysell ..... B24B 7/186 451/353
7,674,069 B2 3/2010 Stenzel
7,690,970 B2 4/2010 Palushaj
7,713,109 B2 5/2010 Estes
7,744,447 B2 * 6/2010 Kodani ..... B24D 7/06 451/259
7,815,393 B2 10/2010 Snyder et al.
7,997,960 B2 8/2011 Williams, Sr.
D657,404 S 4/2012 Brandstetter
8,147,297 B2 * 4/2012 Hamm ..... B24B 41/047 451/270
8,176,909 B2 5/2012 Ilgner
8,192,255 B2 6/2012 Gallup et al.
8,251,780 B2 8/2012 Ward et al.
8,272,924 B2 9/2012 Van Eijden et al.
D678,745 S 3/2013 Nguyen
8,464,420 B2 * 6/2013 Ye ..... B24B 7/186 29/244
D694,081 S 11/2013 Wright
D708,497 S 7/2014 Hoglund
8,790,164 B2 7/2014 Rivard et al.
D731,448 S 6/2015 Kinoshita et al.
D732,917 S 6/2015 Valentini
9,050,625 B1 6/2015 Bonachea Ruiz
D743,456 S * 11/2015 Shinozaki ..... D15/126
9,174,326 B2 11/2015 Ahonen
9,314,899 B2 4/2016 Puchegger et al.
9,580,916 B2 2/2017 Tchakarov et al.
D795,666 S 8/2017 Tchakarov et al.
9,925,645 B2 * 3/2018 Song ..... B24D 7/066
10,011,999 B2 7/2018 Tchakarov et al.
10,046,438 B2 8/2018 Tchakarov
10,092,159 B2 10/2018 Tchakarov
D837,015 S 1/2019 Tchakarov et al.
10,244,914 B2 4/2019 Tchakarov
10,246,885 B2 4/2019 Tchakarov
2001/0048854 A1 12/2001 Carter, Jr.
2003/0029132 A1 2/2003 Ward
2004/0009744 A1 1/2004 Conley et al.
2005/0164620 A1 * 7/2005 Amamoto ..... B23C 5/006 451/548
2005/0172428 A1 8/2005 Thysell
2005/0227600 A1 * 10/2005 Fisher ..... B24D 9/085 451/538
2006/0025059 A1 2/2006 Gueorguiev et al.
2006/0073776 A1 4/2006 Gallup
2006/0211353 A1 9/2006 Kodani et al.
2007/0254568 A1 * 11/2007 Park ..... B24B 41/047 451/548
2007/0292207 A1 * 12/2007 Reed ..... B24B 7/186 404/112

(56) References Cited

U.S. PATENT DOCUMENTS

| | | | | |
|---|---|---|---|---|
| 2008/0108286 | A1 | 5/2008 | Thysell et al. | |
| 2008/0176498 | A1* | 7/2008 | Rossi | B24B 7/186 451/508 |
| 2008/0311826 | A1 | 12/2008 | Thysell | |
| 2009/0053982 | A1 | 2/2009 | Popov | |
| 2009/0190999 | A1 | 7/2009 | Copoulos | |
| 2009/0191799 | A1* | 7/2009 | Rivard | B24D 9/085 451/259 |
| 2010/0136889 | A1 | 6/2010 | Kilgren et al. | |
| 2010/0190421 | A1 | 7/2010 | Hamm et al. | |
| 2010/0240282 | A1 | 9/2010 | Young | |
| 2011/0053468 | A1 | 3/2011 | Vontell | |
| 2011/0092136 | A1 | 4/2011 | Thysell | |
| 2011/0195644 | A1 | 8/2011 | Gallup et al. | |
| 2011/0222966 | A1 | 9/2011 | Allen et al. | |
| 2011/0223845 | A1* | 9/2011 | Van Der Veen | B24B 7/186 451/548 |
| 2011/0300784 | A1* | 12/2011 | Tchakarov | B24B 7/186 451/259 |
| 2012/0270483 | A1* | 10/2012 | Bae | B24B 7/186 451/540 |
| 2013/0000246 | A1 | 1/2013 | Bourelle | |
| 2013/0225051 | A1* | 8/2013 | Vankouwenberg | B24D 11/02 451/350 |
| 2013/0324021 | A1* | 12/2013 | Ryan | B24D 11/00 451/529 |
| 2014/0154961 | A1 | 6/2014 | Fiore | |
| 2015/0328742 | A1 | 11/2015 | Schuele et al. | |
| 2016/0083967 | A1 | 3/2016 | Tchakarov et al. | |
| 2016/0136772 | A1 | 5/2016 | Littlefield et al. | |
| 2016/0144485 | A1 | 5/2016 | Ruan et al. | |
| 2016/0221155 | A1 | 8/2016 | Song et al. | |
| 2017/0129067 | A1 | 5/2017 | Young | |
| 2017/0361414 | A1* | 12/2017 | Tchakarov | B24D 13/14 |
| 2017/0361423 | A1* | 12/2017 | Tchakarov | B24D 13/14 |
| 2018/0200857 | A1 | 7/2018 | Tchakarov | |
| 2018/0206690 | A1* | 7/2018 | Tchakarov | B24D 13/14 |

FOREIGN PATENT DOCUMENTS

| | | | |
|---|---|---|---|
| CA | 162793 | | 7/2015 |
| CA | 162794 | | 7/2015 |
| CA | 162795 | | 7/2015 |
| CA | 162796 | | 7/2015 |
| CA | 162797 | | 7/2015 |
| DE | 20120137 | U1 | 2/2002 |
| DE | 102009008261 | A1 | 8/2010 |
| DE | 202015101442 | U1 | 5/2015 |
| EP | 3348352 | A1 | 7/2018 |
| JP | S49-77293 | U | 7/1974 |
| JP | S56-94267 | U | 7/1981 |
| JP | H01117854 | U | 8/1989 |
| JP | 2001-526593 | A | 12/2001 |
| JP | 2004025401 | A | 1/2004 |
| JP | 2004276197 | A | 10/2004 |
| JP | 2006068885 | A | 3/2006 |
| JP | 2008-532781 | A | 8/2008 |
| JP | 2012232378 | A | 11/2012 |
| JP | 2014-513635 | A | 6/2014 |
| KR | 100816026 | B1 | 3/2008 |
| KR | 100853547 | B1 | 8/2008 |
| WO | 2008/065210 | A1 | 6/2008 |
| WO | WO-2017/053737 | A1 | 3/2017 |

OTHER PUBLICATIONS

Diamond Tool Supply, Inc., "Floor Maintenance and Cleaning—Vortex" Catalog, (published on or before May 2013).
HTC, "Professional Floor Systems" Product catalog 2014, www.htc-floorsystems.com, 2014.
Diamond Tool Supply, Inc., "Floor Maintenance and Cleaning—Monroe" Catalog, (published prior to Sep. 2014).
Diamond Tool Supply, Inc., "Tools for Stone" Catalog, (published prior to Sep. 2014).
Diamond Tool Supply, Inc., "Tools for Concrete" Catalog, (published prior to Sep. 2014).
HTC, "Professional Floor Systems" Product catalogue 2015, www.htc-floorsystems.com, 2015.
Wagman Metal Products Inc., "Concrete Finishing Tools" Catalog, (published prior to Sep. 23, 2016).
iSi GmbH, The System Manufacturer, Brochure Edition, Jan. 12, 2017, 83 pages.
Diamond Tool Supply, Inc., "Monroe Floor Polishing Systems," www.diamondtoolsupply.com, published prior to Sep. 24, 2015, 14 pages.
Diamond Tool Supply, Inc., Various polishing and grinding parts, www.diamondtoolsupply.com, published prior to Sep. 24, 2015, 26 pages.
Wagman Metal Products Inc, "Concrete Finishing Tools," www.WagnamMetal.com, published prior to Sep. 14, 2016, 24 pages.
"Confidential/experimental sale from Diamond Tool Supply, Inc. to Wagman Metal Products on Sep. 1, 2016," 2 pages.
"Diamond Tools for Construction Stone," EHWA Diamond Ind. Co. Ltd. Catalogue, Published 2016, 60 pages.
International Search Report and Written Opinion for International Application No. PCT/US2016/053355 dated Dec. 22, 2016.
International Search Report and Written Opinion for International Application No. PCT/US2018/048845 dated Dec. 5, 2018.
International Search Report and Written Opinion for International Application No. PCT/US2019/013044 dated May 15, 2019.

* cited by examiner

POLISHING OR GRINDING PAD WITH MULTILAYER REINFORCEMENT

BACKGROUND AND SUMMARY

The disclosure relates generally to a pad assembly and more particularly to a floor polishing or grinding pad with a multilayer reinforcement.

It is known to use fibrous pads for polishing and grinding floors within industrial or commercial buildings. Such polishing or grinding pads are ideally suited for use on concrete, terrazzo, and natural (e.g., marble), engineered and composite stone floors. Examples of such pads and the powered machines used to rotate such can be found in the following U.S. patent publication numbers: 2011/0300784 entitled "Flexible and Interchangeable Multi-Head Floor Polishing Disk Assemby" which was invented by Tchakarov et al. and published on Dec. 8, 2011; 2017/0361423 entitled "Polishing or Grinding Pad Assembly" which was invented by Tchakarov and published on Dec. 21, 2017; and 2017/0361414 entitled "Polishing or Grinding Pad Assembly" which was invented by Tchakarov and published on Dec. 21, 2017. All of these patent publications are incorporated by reference herein. While these prior constructions are significant improvements in the industry, improved floor polishing and grinding performance, and improved durability of the pad assembly are still desired.

In accordance with the present invention, a polishing or grinding pad with a multilayer reinforcement is provided. In one aspect, a floor polishing or grinding pad assembly employs a flexible pad, at least two reinforcement layers or rings with different characteristics, and multiple floor-contacting tools such as abrasive disks. In another aspect, a workpiece polishing or grinding pad assembly includes a flexible and rotatable pad, a polymeric reinforcement layer coupled to the pad and a metallic reinforcement layer to which are coupled abrasive tools. In yet another aspect, a floor-facing reinforcement is more flexible than a pad-facing reinforcement which is more rigid. A further aspect employs scallops or recesses on an outer periphery of a reinforcement ring. A method of making and using a flexible pad, employing a multilayer reinforcement with multiple polishing or grinding tools attached thereto, is also presented.

The present pad assembly is advantageous over traditional devices. For example, the scallops or recesses of the metallic or floor-facing reinforcement used in the present pad assembly advantageously creates a clearance to the floor during pad and reinforcement flexure, thereby reducing contact, and thus wear, of the floor-facing reinforcement when polishing or grinding; this angular clearance increases the assembly's useful life and deters floor-scraping while providing consistency of polishing or grinding. Furthermore, the present pad assembly advantageously allows greater floor contact with the multiple abrasive tools due to the metallic reinforcement flexing due to floor imperfections, yet reduces premature reinforcement wear by providing additional rigidity due to the addition of the less expensive polymeric reinforcement, which is expected to reduce downward flexure of the metal reinforcement between the tools. Additional advantages and features of the present invention will be readily understood from the following description, claims and appended drawings.

DETAILED DESCRIPTION

Figure 1:
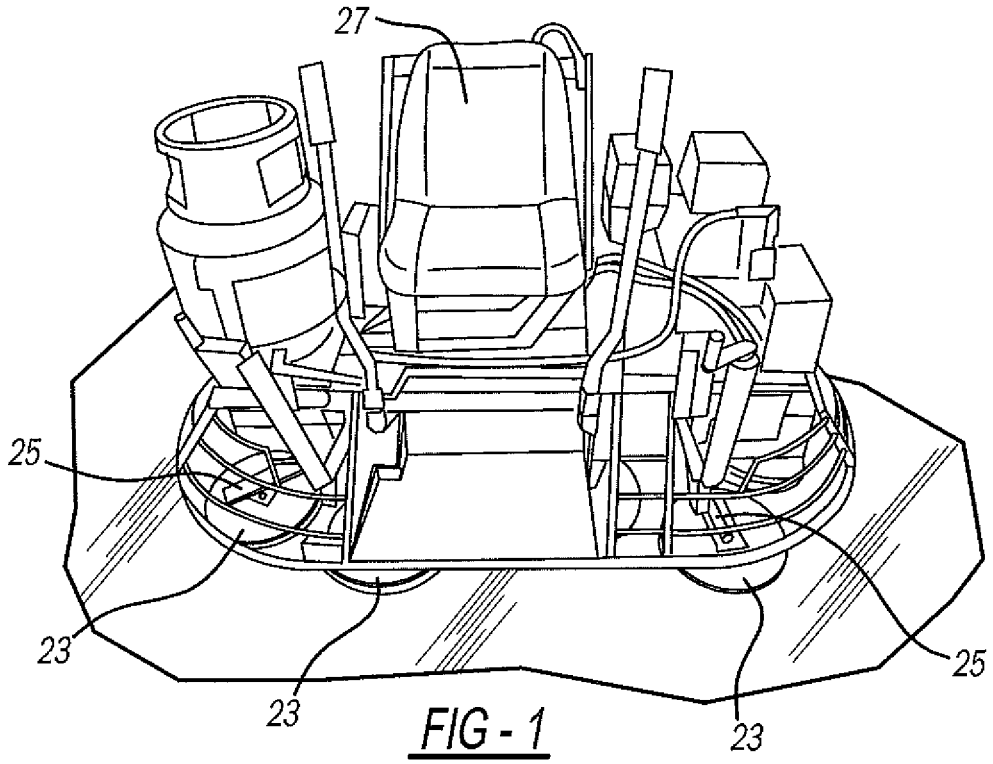
FIG. 1 is a top perspective view showing a first embodiment of a pad assembly and a powered floor polishing or grinding machine.
Figure 2:
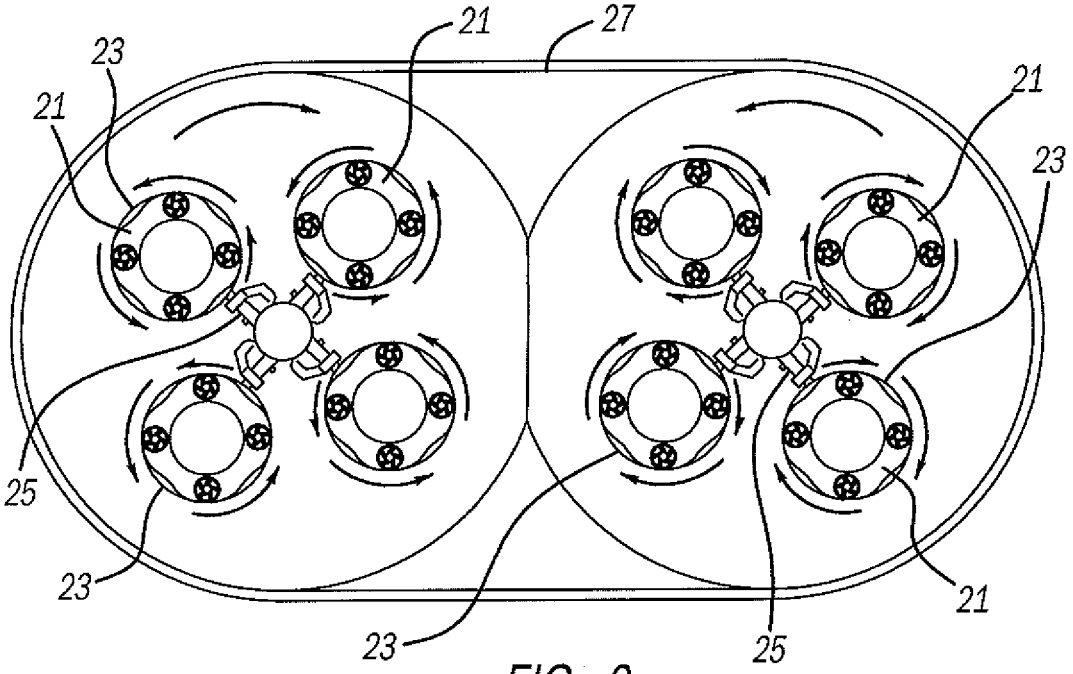
FIG. 2 is a diagrammatic bottom elevational view showing the first embodiment pad assembly and machine.
Figure 3:
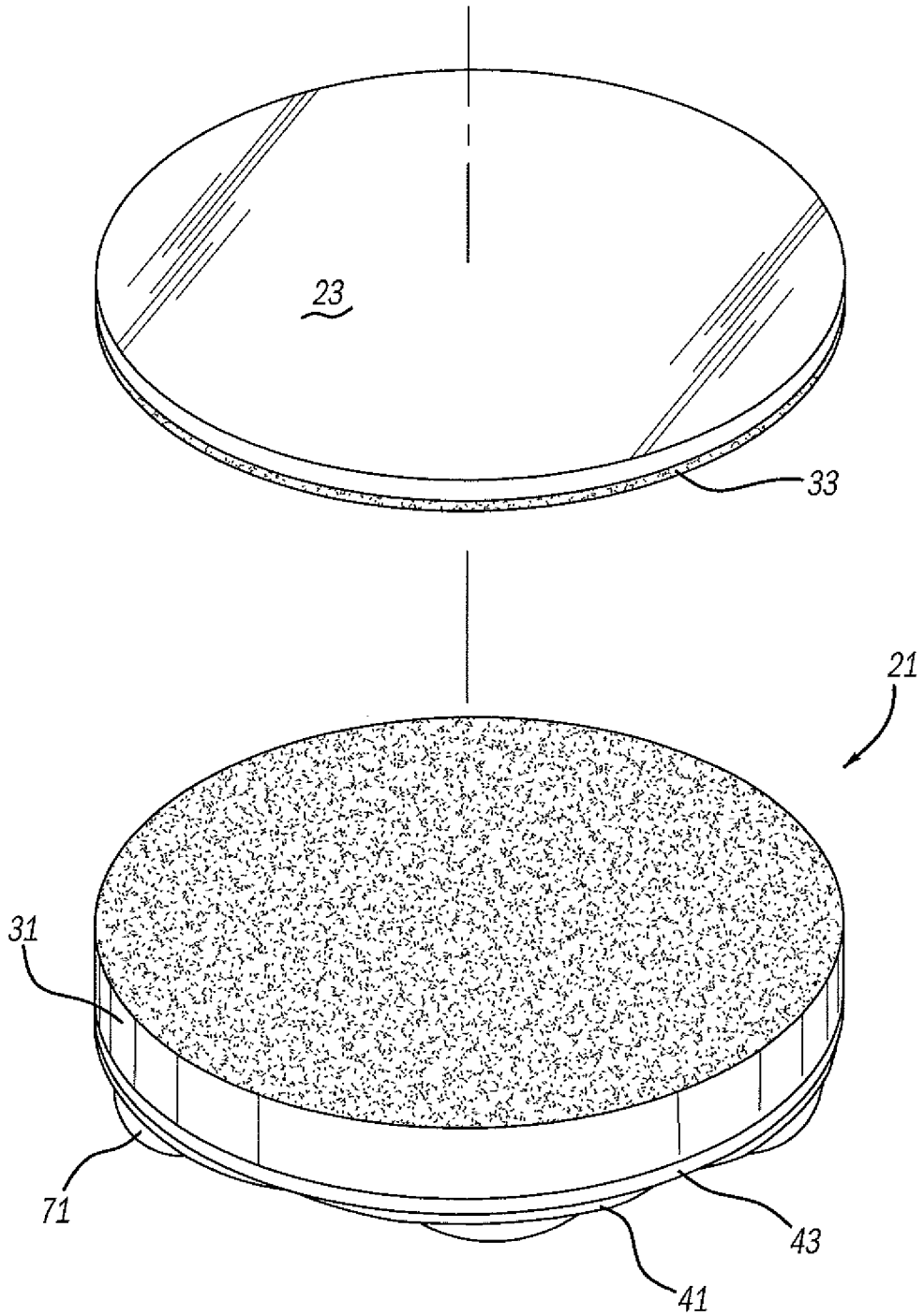
FIG. 3 is a top, partially exploded perspective view showing the first embodiment pad assembly.
Figure 4:
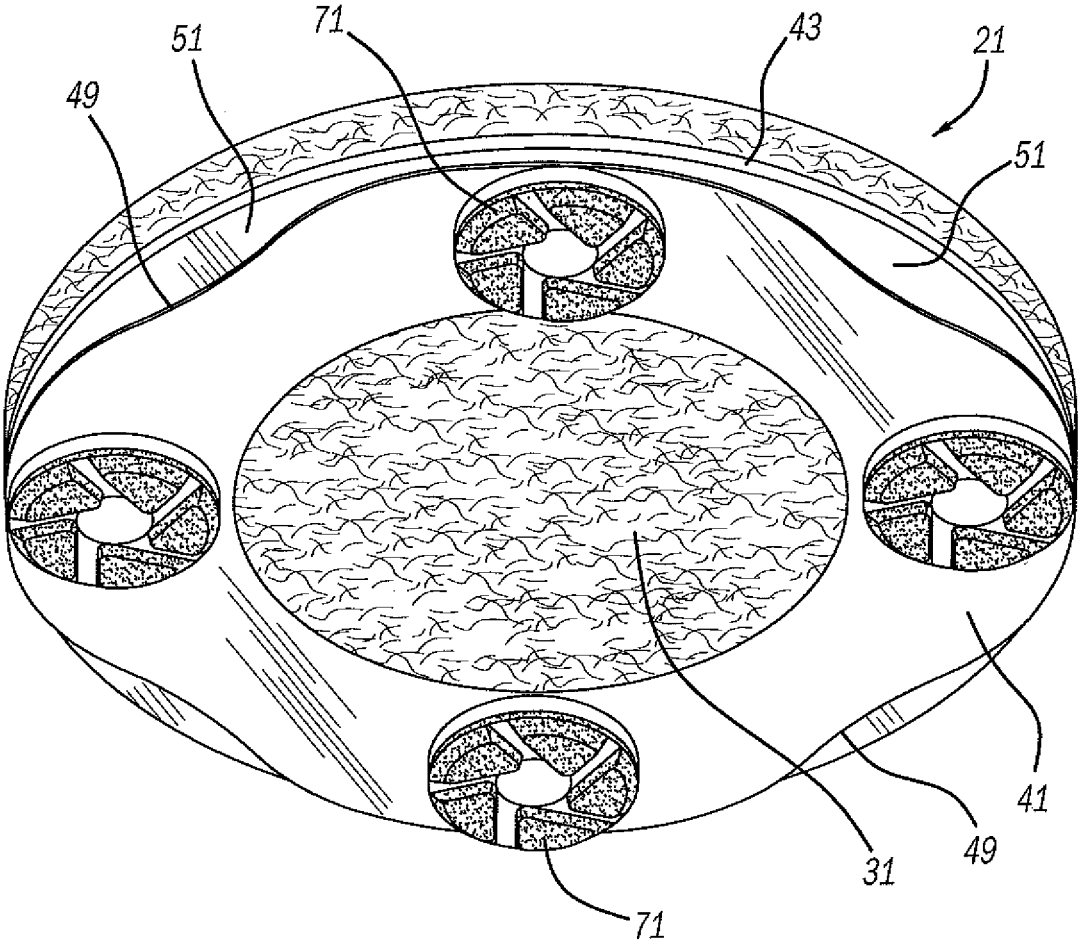
FIG. 4 is a bottom perspective view showing the first embodiment pad assembly.

A first embodiment of a pad assembly 21 is shown in FIGS. 1-4. Pad assembly 21 is used for grinding or polishing composite workpiece surfaces, such as a concrete floor. Pad assemblies 21 are attached to rotating plates 23 which are rotated in a planetary motion by motor-driven arms 25. The plates and arms are part of a ride-on power trowel machine 27 or walk-behind machine. Such machines are disclosed in U.S. Pat. No. 7,815,393, entitled "Mounting Adapter for Concrete Surface Processing Tool" which issued to Snyder et al. on Oct. 19, 2010, U.S. Pat. No. 6,536,989 entitled "Finishing Device for Floors Made of Hardenable Material and Blade Used Therewith" which issued to Rijkers on Mar. 25, 2003, and U.S. Patent Publication No. 2011/0222966 entitled "Hydraulic Riding Trowels with Automatic Load Sensing" which published to Allen et al. on Sep. 15, 2011, all of which are incorporated by reference herein.

Figure 5:
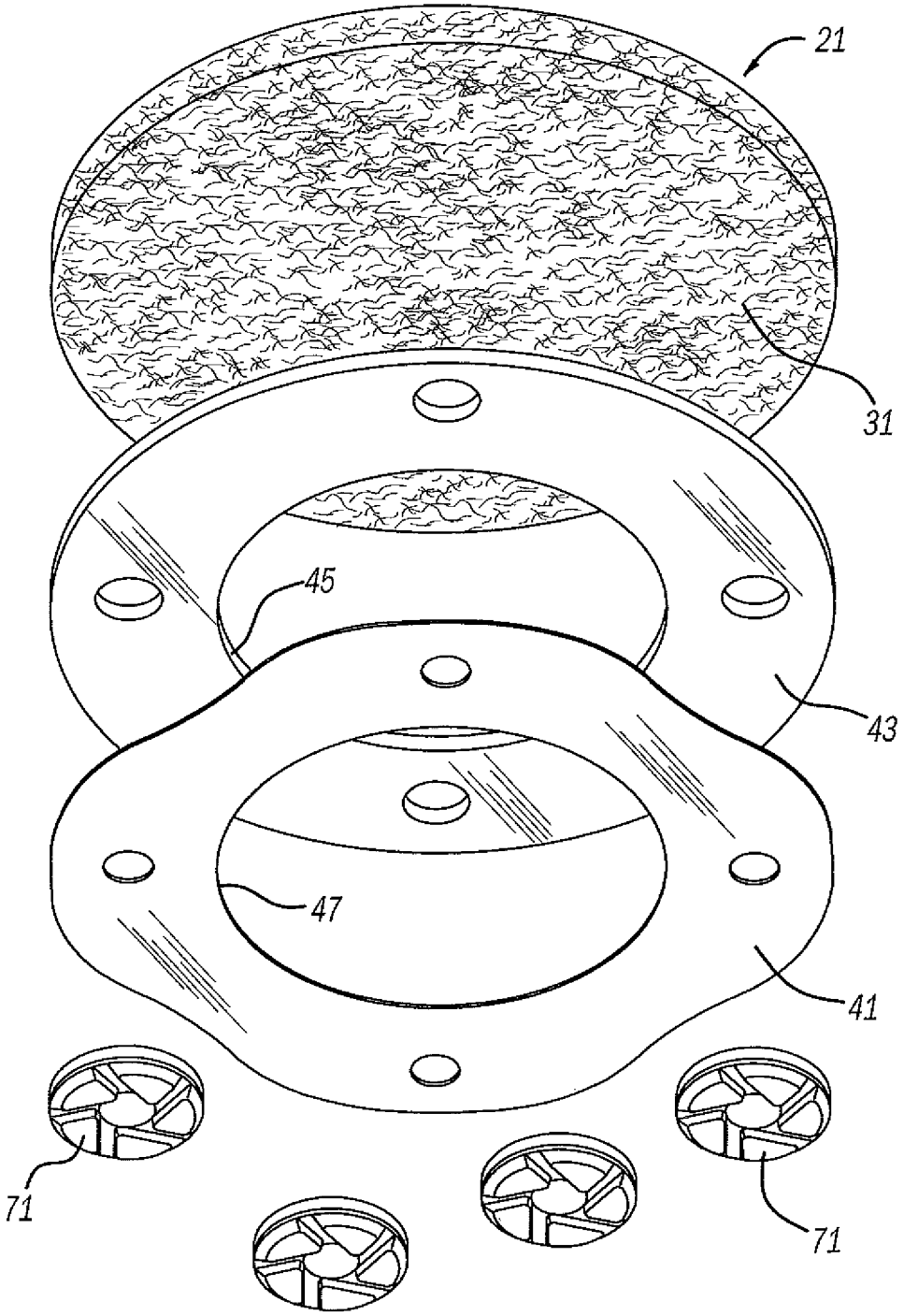
FIG. 5 is a bottom, exploded perspective view showing the first embodiment pad assembly.
Figure 6:
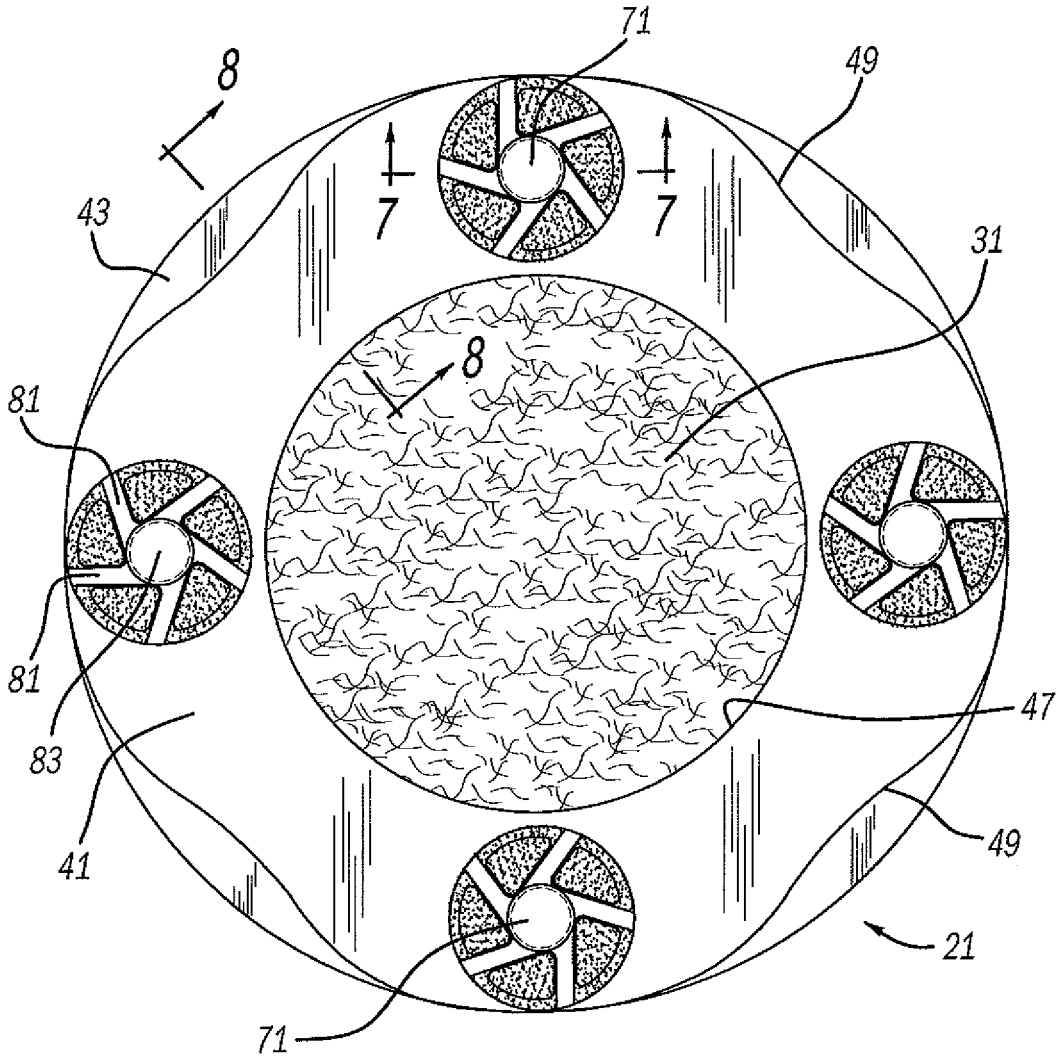
FIG. 6 is a bottom elevational view showing the first embodiment pad assembly.
Figure 9:
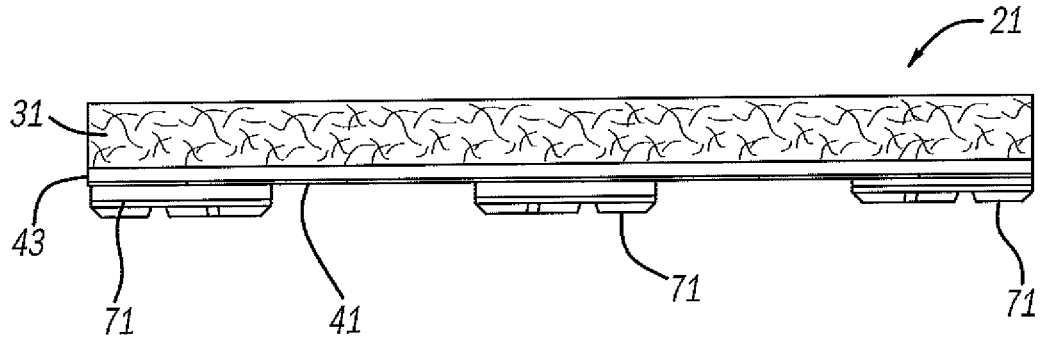
FIG. 9 is a side elevational view showing the first embodiment pad assembly.
Figure 7:
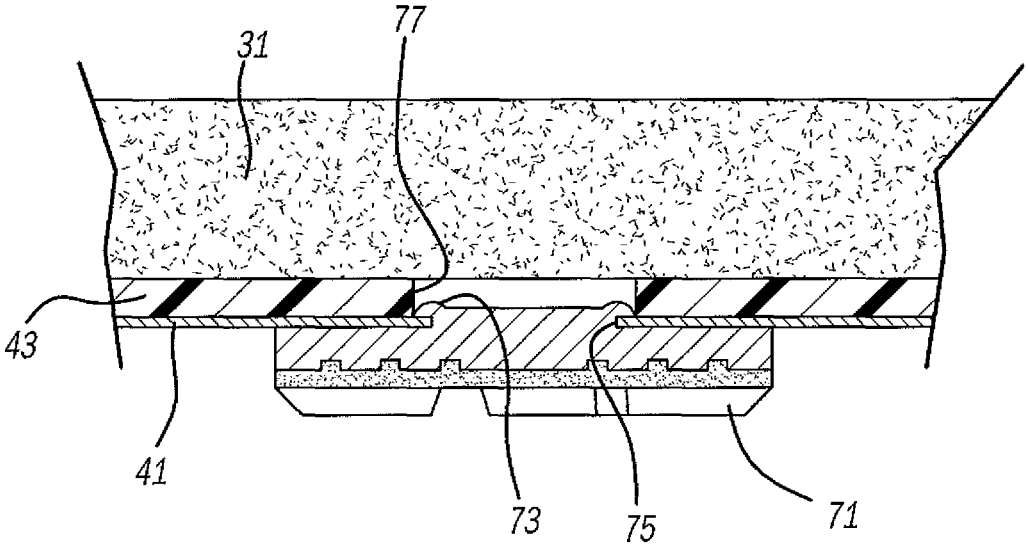
FIG. 7 is a cross-sectional view, taken along line 7-7 of FIG. 6, showing the first embodiment pad assembly.
Figure 8:
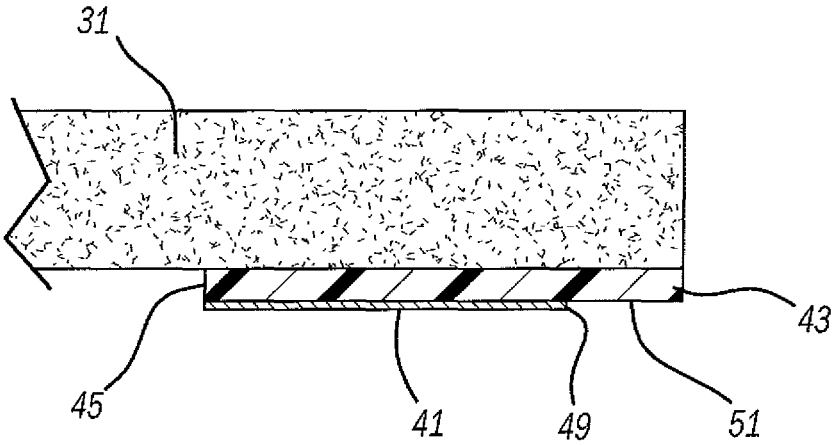
FIG. 8 is a cross-sectional view, taken along line 8-8 of FIG. 6, showing the first embodiment pad assembly.

Referring to FIGS. 3-9, pad assembly 21 includes a base pad 31, which is a porous, fibrous, flexible and deformable material, including natural and/or artificial fibers, optionally with resin and diamond particles. Alternately, pad 31 may be rubber, an elastomeric polymer, foam, felt or other durable but flexible material. Base pad 31 is generally circular with generally flat top and bottom surfaces. It has a peripheral diameter of at least 7 inches (178 mm), more preferably 11 inches (279 mm), and a thickness of at least 0.5 inch (13 mm) and more preferably 0.75 inch (20 mm) for this embodiment. Of course, the pad could be made in other sizes. Pad 31 is removeably attached to plate 23 by hook and loop fasteners 33 on a top surface thereof.

A multilayer reinforcement ring or layer includes a floor-facing and lower ring or layer 41, and a pad-facing or intermediate ring or layer 43. Pad-facing ring 43 is secured to a bottom face of base pad 31, such as by adhesive. The pad-facing reinforcement ring 43 is generally annular having a central opening 45 with a diameter, for example, of approximately 6.3 inches (160 mm), which surrounds a centerline or rotational axis of pad 31. Furthermore, pad-facing ring 43 is preferably cut from a sheet of ABS polymer with an exemplary thickness of about 0.197 inch (5 mm).

Floor-facing reinforcement ring 41 has an internal hole 47 surrounding the rotational axis of the pad and exposing a center of pad to the floor workpiece. Floor-facing ring 41 has equally spaced apart recesses or arcuate scallops 49 in a peripheral edge thereof. This exposes bottom surface portions 51 of pad-facing ring 43 such that it is unlikely that floor-facing ring 41 will directly contact against the floor even when the floor-facing ring is flexed and tilted. Floor-facing ring 41 is preferably metallic spring steel, having a thickness greater than zero and up to 0.125 inch (preferably 0.25-0.5 mm). Metallic ring 41 is thinner and more flexible than the more rigid yet still flexible polymeric ring 43. Pad-facing reinforcement ring 43 reinforces and adds some stiffness to the floor-facing ring 41, especially where it spans between the abrasive tools, however, the multilayer ring allows some flexibility to pad assembly 21 so it can flex with and follow any floor imperfections thereby producing uniform floor contact for polishing or grinding. Adhesive bonds together at least a majority of the rings at their interfacing surfaces. From a manufacturing and materials cost standpoint, it is less expensive to employ the composite polymer-metal multilayer reinforcement than it is to use only a single thicker metallic ring.

A plurality of abrasive tools, preferably floor-contacting disks 71, are secured to the bottom surface of floor-facing reinforcement ring 41. In the example shown, abrasive tools 71 are approximately 2 inch (54 mm) disks of diamond particles in a polymeric resin matrix. In the example shown, more than two and, more preferably four, of the abrasive tools are generally equally spaced apart and secured to the multilayer reinforcement ring. The disks are fastened to floor-facing ring 41 by crimping central posts 73 extending from a backside of heads of the disks, into holes 75 in the ring. A slightly larger diameter hole 77 of pad-facing ring 43 is coaxially aligned with each hole 75 to provide clearance for the mushroomed post.

As one example, the abrasive pattern of the bottom head of each disk 71 employs at least three, and more preferably five, of linearly elongated channels or spokes 81 which outwardly radiate from a solid center 83 with an innermost end of each spoke being offset from a centerline. Alternately, concentric circles or other channel configurations can be used.

It is noteworthy that inner edges defining holes 45 and 47 of the multilayer ring have a diameter or linear dimension which is larger than a linear dimension of a solid section of the ring layers 41 and 43 which are adjacent to one side of the holes. More preferably, the hole dimensions are at least twice as large as the ring dimensions. The hole relationship is expected to improve floor contact by the fibrous central portion of pad 31 within the inner holes.

Figure 10:
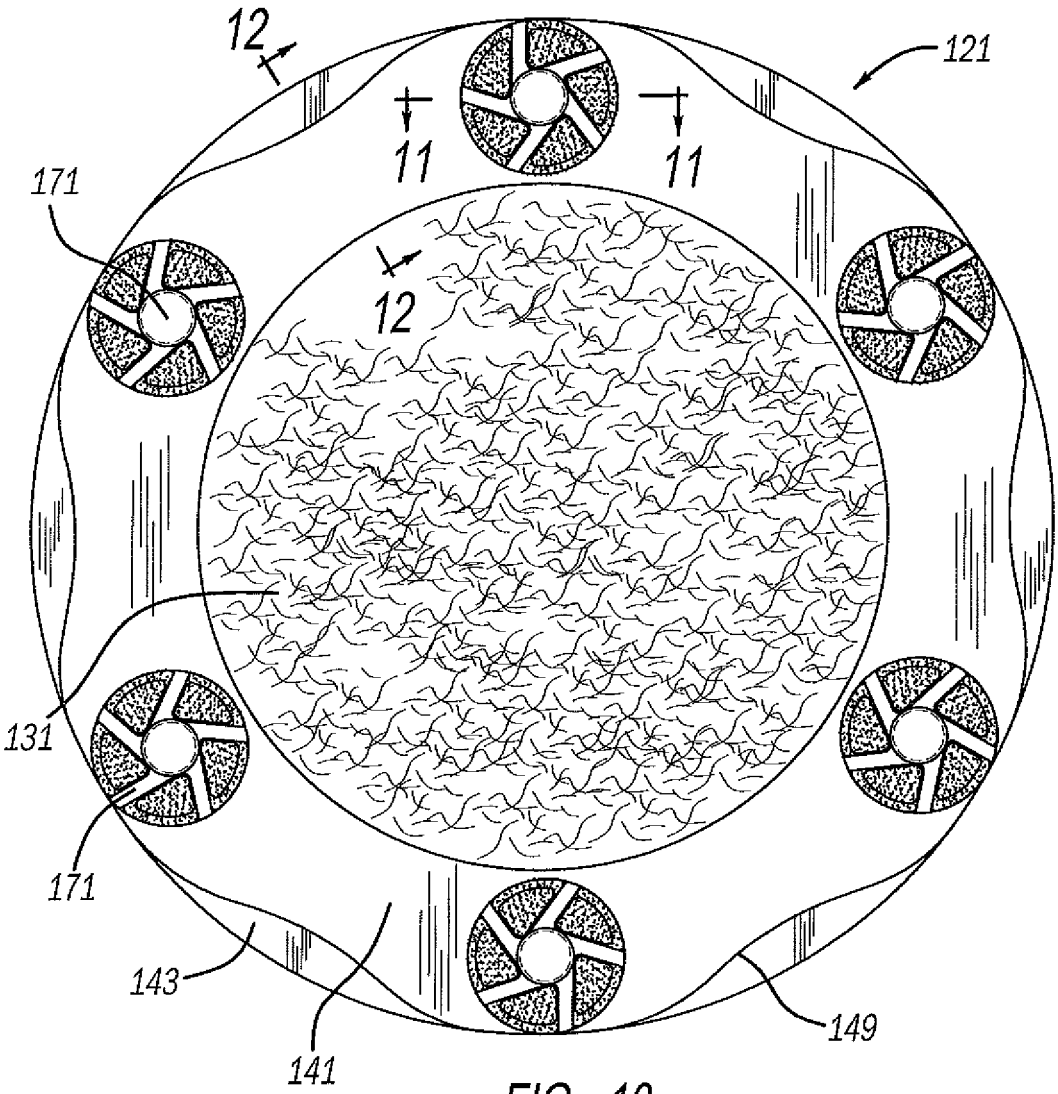
FIG. 10 is a bottom elevational view showing a second embodiment of the pad assembly.
Figure 13:
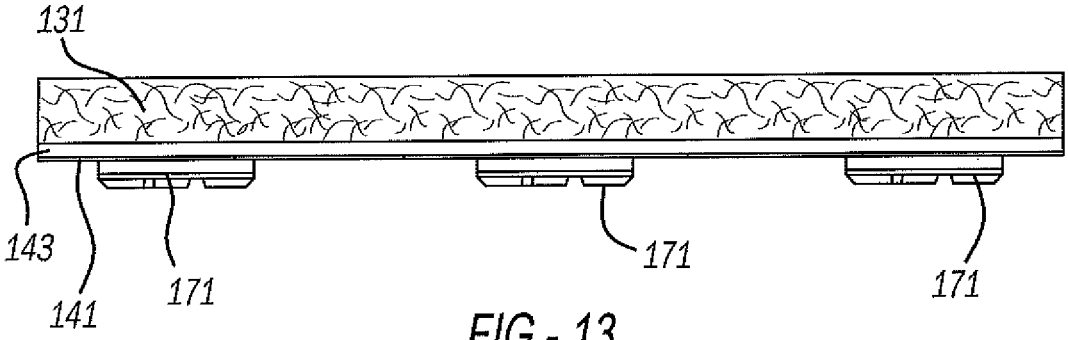
FIG. 13 is a side elevational view showing the second embodiment pad assembly.
Figure 11:
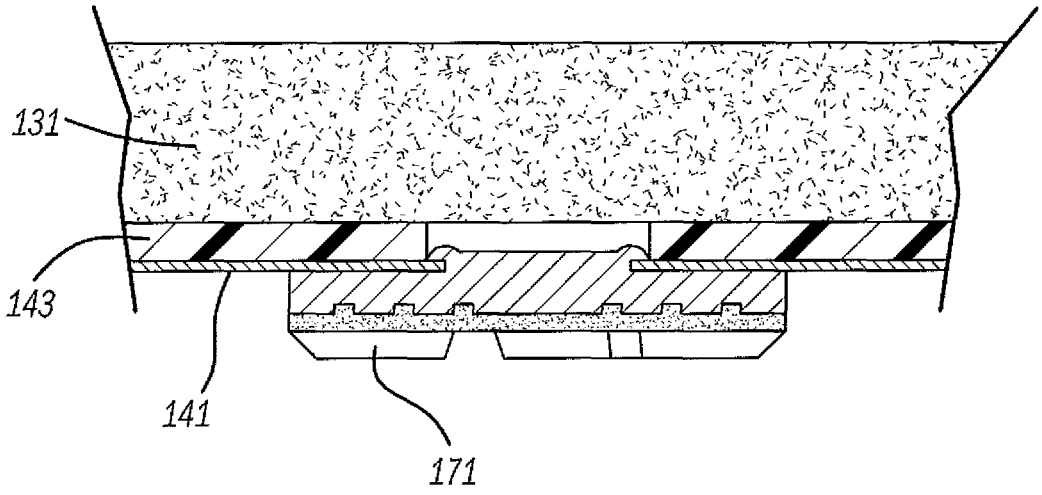
FIG. 11 is a cross-sectional view, taken along line 11-11 of FIG. 10, showing the second embodiment pad assembly.
Figure 12:
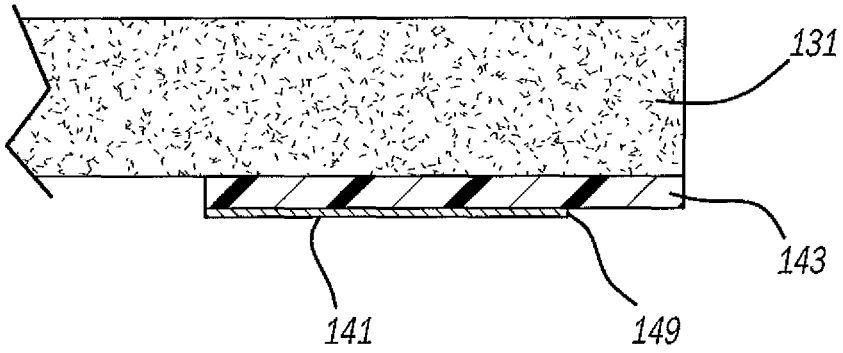
FIG. 12 is a cross-sectional view, taken along line 12-12 of FIG. 10, showing the second embodiment pad assembly.

FIGS. 10-13 illustrate another embodiment of a workpiece polishing or grinding pad assembly 121. The flexible and rotatable pad 131 and polymer/metallic multilayer reinforcement ring is essentially the same as the prior embodiment. This configuration, however, includes six abrasive tools or disks 171. Furthermore, rings 141 and 143 have a larger circular peripheral dimension (such as diameter), preferably of 14 inches (355.6 mm). Thus, there are six scalloped recesses 149 in the periphery of the floor-facing reinforcement ring.

Figure 14:
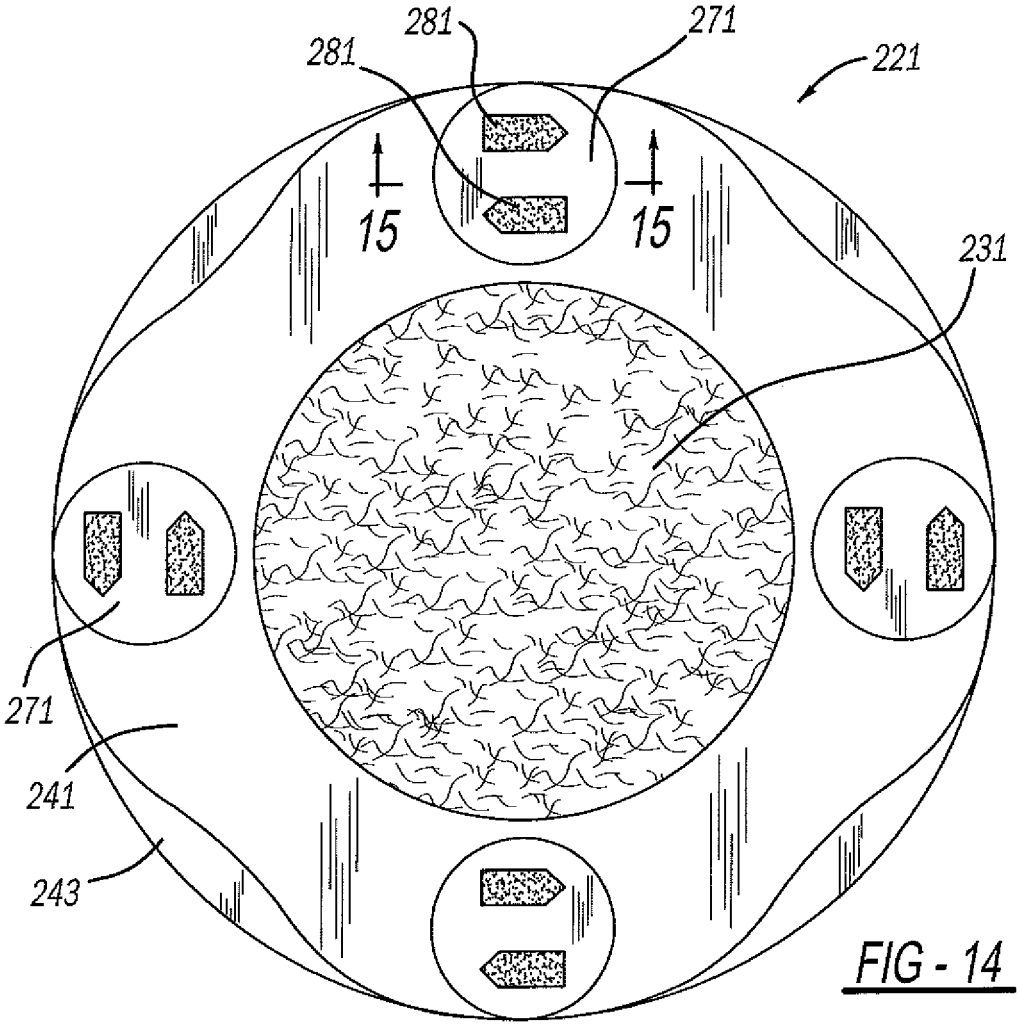
FIG. 14 is a bottom elevational view showing a third embodiment of the pad assembly.
Figure 15:
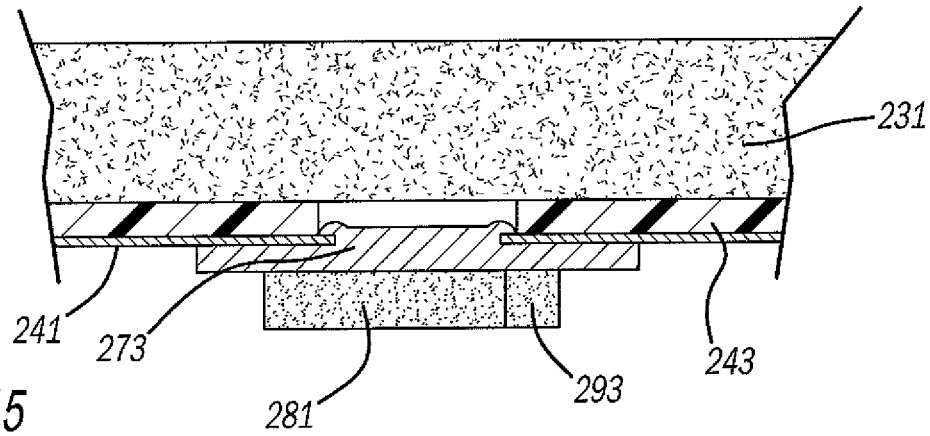
FIG. 15 is a cross-sectional view, taken along line 15-15 of FIG. 14, showing the third embodiment pad assembly.
Figure 16:
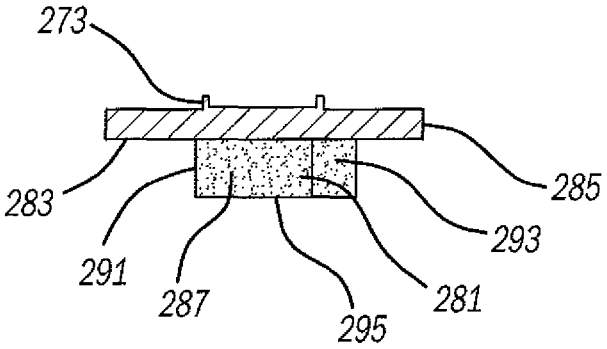
FIG. 16 is a cross-sectional view, like that of FIG. 15, showing an abrasive tool (before reinforcement ring attachment) of the third embodiment pad.
Figure 17:
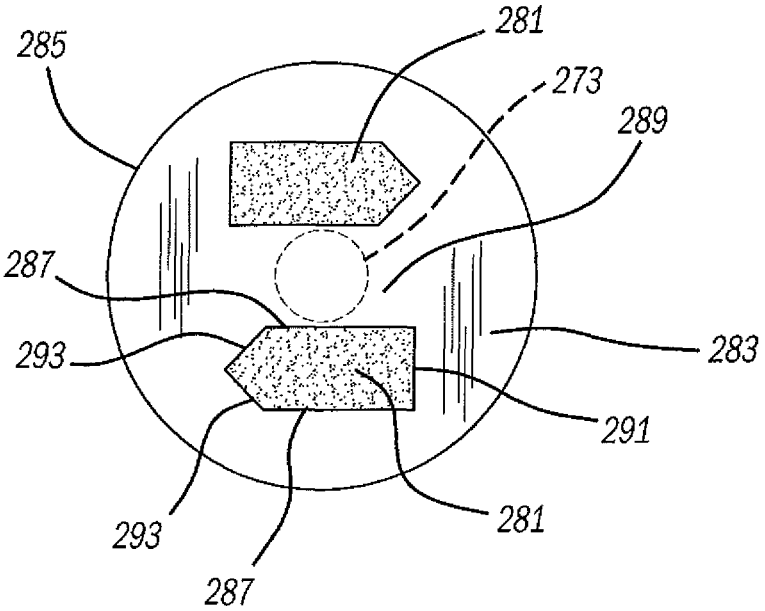
FIG. 17 is a bottom elevational view showing the abrasive tool of the third embodiment pad assembly.
Figure 18:
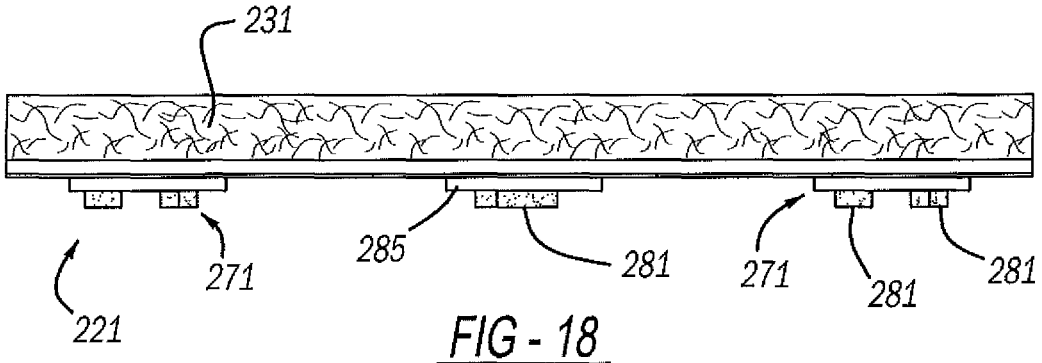
FIG. 18 is a side elevational view showing the third embodiment pad assembly.
Figure 19:
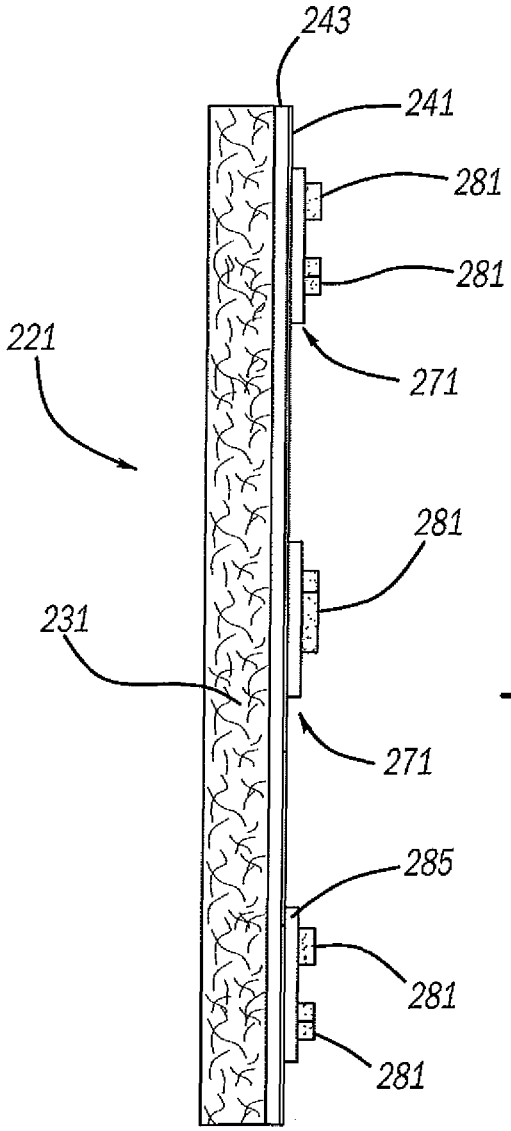
FIG. 19 is a side elevational view, perpendicular to that of FIG. 18, showing the third embodiment pad assembly.

Another embodiment of a workpiece polishing or grinding pad assembly 221 is shown in FIGS. 14-19. A pad 231, polymeric reinforcement ring 243 and metallic reinforcement ring 241 are essentially the same as either of the prior constructions discussed hereinabove. With the present exemplary pad assembly 221, however, each abrasive tool 271 includes multiple raised wedge segments or formations 281 projecting from a bottom surface 283 of a laterally enlarged head 285. Wedges 281 include generally vertical side walls 287 which are parallel, with the inner side walls of each pair of wedges facing each other but being separated by a gap 289. Gap 289 is wider than a width of each wedge 281. Each wedge further includes a rear wall 291, substantially perpendicular to side walls 287, and one or more tapered leading walls 293. Leading walls 293 preferably include two tapers intersecting at an apex point aligned with an elongated centerline of wedge 281. The tapered leading walls are on an end opposite each other for the pair of wedges of this version, which advantageously allows for easy bidirectional assembly to the multilayer reinforcement and allows these tools to be used without a need to reverse their orientation regardless of the rotational direction of the pad.

In one example, a floor-contacting face 295 is at least 0.25 inch (6.35 mm) and more preferably 0.39 inch (10 mm) below surface 283 of tool head 285. Furthermore, an elongated linear dimension of side walls 287 is greater than a width dimension between sidewalls 287 of each wedge. A post 273 centrally projects from the backside of head 285 for crimped attachment to the multilayer reinforcement. A periphery of head 285 is somewhat circular and disk-like although other somewhat polygonal or arcuate shapes may be employed, although some of the advantages may not be realized. Moreover, at least three, and more preferably four tools 271 are provided for an 11 inch (279 mm) outside diameter pad while six tools 271 are provided for a 14 inch (355.6 mm) outside diameter pad. These wedge tool configurations may be employed with a single reinforcement, multilayer reinforcement, inner or outer edge recessed reinforcement or even directly adhered to the pad, although many of the aforementioned multilayer reinforcement ring benefits may not be achieved.

The wedge tools are ideally suited for removing an epoxy coating, paint or other materials from a workpiece, especially a cement floor, through rotation by a powered machine. While angled or tapered leading walls 293 are functionally advantageous, the overall shapes and spacing of wedges 281 on the tools or disks 271 have ornamental and aesthetic benefits. Furthermore, the exact scalloped shapes of the recesses for floor-facing reinforcement ring 241 also has ornamental features.

While various embodiments have been disclosed, it should be appreciated that additional variations of the pad assembly are also envisioned. For example, while preferred dimensions have been disclosed hereinabove, it should alternately be appreciated that other dimensions may be employed; for example a peripheral pad diameter of at least 10 inches (254 mm) may be employed and disk diameters of 0.5-2.5 inches (12.7-63.5 mm) may also be employed. Moreover, circular peripheral shapes for the pad, reinforcement ring and disks are preferred, however, other arcuate or even generally polygonal peripheral shapes may be used although certain of the present advantages may not be fully realized. Alternate recess shapes are possible. It is also envisioned that different abrading patterns may be employed on the abrasive tools (such as disks) which may be attached to the multilayer reinforcement ring with a rivet, adhesive or other fasteners.

Furthermore, it is also possible to employ three or more reinforcement layers with differing characteristics, although some of the present cost advantages may not be achieved. Alternately, other fastening of the rings can be used but adhesive is more beneficial. While certain materials have been disclosed it should be appreciated that alternate materials may be used although all of the present advantages may not be fully achieved. It is also noteworthy that any of the preceding features may be interchanged and intermixed with any of the others. Accordingly, any and/or all of the dependent claims may depend from all of their preceding claims and may be combined together in any combination. Variations are not to be regarded as a departure from the present disclosure, and all such modifications are entitled to be included within the scope and sprit of the present invention.

The invention claimed is:

1. A polishing or grinding pad assembly comprising:

(a) a flexible and rotatable pad;

(b) a polymeric ring attached to the pad and having a central opening exposing the flexible and rotatable pad;

(c) a metallic ring attached to the polymeric ring and having an inner hole exposing the flexible and rotatable pad; and (d) abrasive tools contacting against a bottom surface of the metallic ring, wherein the metallic ring includes an outer periphery having recesses radially arranged thereon between each of the abrasive tools, and wherein the recesses are arcuate scallops which expose bottom surface portions of the polymeric ring.

2. The pad assembly of claim 1, wherein:

a periphery of the polymeric ring is circular;

the central opening of the polymeric ring is circular; and the inner hole of the metallic ring is circular.

3. The pad assembly of claim 1, wherein:

the metallic ring is spring steel;

the pad includes diamonds and fibers; and the polymeric ring is flexible but more rigid than the metallic ring.

4. The pad assembly of claim 1, wherein:

there are at least three of the abrasive tools which are disks, each with a circular periphery; and the disks each include a post projecting from a backside thereof which is crimped to the metallic ring but not to the polymeric ring.

5. The pad assembly of claim 1, wherein the metallic ring and the polymeric ring are adhesively bonded together.

6. The pad assembly of claim 1, wherein:

the pad is configured to be rotated by a floor grinding or polishing machine; and wherein the metallic ring is thinner than the polymeric ring, and wherein the polymeric ring is thinner than the pad.

7. The pad assembly of claim 1, wherein at least one of the abrasive tools includes multiple spaced apart, elongated and parallel wedges mounted on a laterally enlarged head.

8. A polishing or grinding pad assembly comprising:

(a) a flexible and rotatable pad;

(b) a polymeric flexible reinforcement ring coupled to the pad, the polymeric flexible reinforcement ring being coaxial with the pad, (c) a metallic reinforcement ring coupled to the polymeric ring, wherein an outer periphery of the metallic reinforcement ring having recesses radially arranged thereon;

(d) abrasive tools coupled to the metallic reinforcement ring with the took being substantially equally spaced around the outer periphery of the at least one reinforcement ring and between the recesses, wherein the recesses are arcuate scallops formed in the metallic reinforcement ring which expose bottom surface portions of the polymeric reinforcement ring.

9. The pad assembly of claim 8, wherein:

a periphery of the polymeric reinforcement ring is circular;

an inner edge of the polymeric reinforcement ring is circular; and an inner edge of the metallic reinforcement ring is circular.

10. The pad assembly of claim 8, wherein each of the polymeric and the metallic reinforcement rings have central holes therein.

11. The pad assembly of claim 8, wherein:

there are at least three of the abrasive tools which are disks, each with a circular periphery; and the disks each include a post projecting from a backside thereof which is crimped to metallic reinforcement ring.

12. The pad assembly of claim 8, wherein at least one of the abrasive tools includes an elongated wedge with a tapered end.

* * * * *